US010240299B2

(12) United States Patent
Constantine et al.

(10) Patent No.: US 10,240,299 B2
(45) Date of Patent: Mar. 26, 2019

(54) MECHANISM AND SYSTEM FOR FASTENING TRACK RAIL TO A SUBSTRATE AND TRACK RAIL FASTENING METHOD

(71) Applicant: Progress Rail Services Corporation, Albertville, AL (US)

(72) Inventors: Edward Constantine, Kansas City, MO (US); Wilbur Osler, Mattituck, NY (US)

(73) Assignee: Progress Rail Services Corporation, Albertville, AL (US)

( * ) Notice: Subject to any disclaimer, the term of this patent is extended or adjusted under 35 U.S.C. 154(b) by 310 days.

(21) Appl. No.: 15/218,571

(22) Filed: Jul. 25, 2016

(65) Prior Publication Data

US 2018/0023257 A1 Jan. 25, 2018

(51) Int. Cl.

| | |
|---|---|
| ***E01B 9/40*** | (2006.01) |
| ***E01B 9/48*** | (2006.01) |
| ***E01B 9/62*** | (2006.01) |

(52) U.S. Cl.

CPC ..... *E01B 9/62* (2013.01); *E01B 9/40* (2013.01); *E01B 9/483* (2013.01)

(58) Field of Classification Search

CPC ..... E01B 9/00; E01B 9/02; E01B 9/38; E01B 9/42; E01B 9/48; E04B 1/16

See application file for complete search history.

(56) References Cited

U.S. PATENT DOCUMENTS

| | | | | |
|---|---|---|---|---|
| 4,561,589 | A | 12/1985 | Hixson | |
| 4,718,604 | A * | 1/1988 | Eisenberg | E01B 9/303 238/338 |
| 6,974,087 | B2 * | 12/2005 | Faichney | E01B 9/48 238/264 |
| 7,992,796 | B2 * | 8/2011 | Bednarczyk | E01B 9/40 238/264 |
| 8,602,317 | B2 * | 12/2013 | Bosterling | E01B 9/38 238/312 |
| 8,603,376 | B1 | 12/2013 | Sands et al. | |
| 8,740,106 | B2 * | 6/2014 | Ryou | E01B 9/483 238/338 |
| 2006/0196962 | A1 * | 9/2006 | Osler | E01B 9/62 238/287 |
| 2007/0235551 | A1 | 10/2007 | Ellerhorst | |
| 2008/0265050 | A1 * | 10/2008 | Osler | E01B 9/10 238/315 |

(Continued)

FOREIGN PATENT DOCUMENTS

| | | |
|---|---|---|
| EP | 1079023 | 2/2001 |
| KR | 200459502 | 3/2012 |

(Continued)

*Primary Examiner* — Jason C Smith

(74) *Attorney, Agent, or Firm* — Mattingly Burke Cohen & Biederman

(57) ABSTRACT

A fastening mechanism for coupling track rail to a substrate includes a fastener body formed by a metallic base and an overmolded non-metallic coating. Metallic pillars are coupled with the fastener body, and define bores for receiving anchors held fast within a substrate. The coating encases the metallic base and extends peripherally around the metallic pillars to position vibration-attenuating non-metallic material between the metallic base and the metallic pillars.

20 Claims, 3 Drawing Sheets

(56) References Cited

U.S. PATENT DOCUMENTS

| | | | | |
|---|---|---|---|---|
| 2011/0068184 | A1* | 3/2011 | Rademacher | E01B 9/42 238/282 |
| 2012/0091216 | A1* | 4/2012 | Osler | E01B 9/38 238/283 |
| 2014/0231534 | A1* | 8/2014 | Osler | E01B 9/02 238/287 |
| 2015/0060561 | A1* | 3/2015 | Ciloglu | E01B 9/60 238/315 |
| 2018/0023256 | A1* | 1/2018 | Constantine | E01B 9/42 238/290 |

FOREIGN PATENT DOCUMENTS

| | | |
|---|---|---|
| KR | 20140109039 | 9/2014 |
| WO | 2012160238 | 11/2012 |

* cited by examiner

MECHANISM AND SYSTEM FOR FASTENING TRACK RAIL TO A SUBSTRATE AND TRACK RAIL FASTENING METHOD

TECHNICAL FIELD

The present disclosure relates generally to fastening track rail to a substrate, and more particularly to positioning vibration-attenuating non-metallic material between a metallic base of a fastening mechanism and metallic pillars coupled to anchors within the substrate.

BACKGROUND

Rail equipment is widely used throughout the world for transportation of persons and all manner of goods. Rail lines formed by parallel track rails supported upon a concrete or gravel substrate will be familiar to most. Depending upon the manner of supporting the rails, a variety of different mechanisms are in widespread use for maintaining a desired positioning of the rails and, to a certain extent, reducing vibration and shocks transmitted between locomotives or rail cars and the underlying substrate.

Rail fixation systems can range from relatively simple plates attached to wooden ties partially buried in a gravel substrate, to more sophisticated fixation mechanisms consisting of a relatively complex assembly of metallic and non-metallic components. One known example is set forth in United States Patent Application Publication No. 2015/0060561 to Ciloglu et al. Ciloglu et al. proposes a design where a section of track rail is supported between fasteners attached to a substrate and insulating elements, apparently for the purpose of reducing corrosion-causing currents, and placed at various locations. Ciloglu et al. is relatively complex, and for this and other reasons there is ample room for improvement.

SUMMARY OF THE INVENTION

In one aspect, a fastening mechanism for coupling track rail to a substrate includes a fastener body formed by a metallic base and an overmolded non-metallic coating encasing the metallic base. The fastener body includes a horizontally extending lower side, and a horizontally extending upper side having a rail support surface extending fore and aft between a front edge and a back edge of the fastener body, and laterally between a left outboard edge and a right outboard edge of the fastener body. The mechanism further includes a first metallic pillar positioned at a first location laterally between the rail support surface and the left outboard edge, and a second metallic pillar positioned at a second location laterally between the rail support surface and the right outboard edge. The first metallic pillar and the second metallic pillar define a first vertically extending bore and a second vertically extending bore, respectively, and each of the first vertically extending bore and the second vertically extending bore communicating between the lower side and the upper side of the fastener body and being structured to receive an anchor held fast within the substrate and coupled to the corresponding first metallic pillar or second metallic pillar. The overmolded non-metallic coating extends peripherally around each of the first metallic pillar and the second metallic pillar to position vibration-attenuating non-metallic material of the coating between the metallic base and each of the first metallic pillar and the second metallic pillar.

In another aspect, a system for fastening track rail includes a fastening mechanism having a fastener body formed by a metallic base and an overmolded non-metallic coating encasing the metallic base, and including a rail support surface for supporting a track rail thereon at a location vertically above a substrate. The fastening mechanism further includes a first metallic pillar positioned at a first location on a first lateral side of the rail support surface, and a second metallic pillar positioned at a second location on a second lateral side of the rail support surface. The first metallic pillar and the second metallic pillar define a first vertically extending bore and a second vertically extending bore, respectively, each structured to receive an anchor held fast within the substrate. The system further includes a first coupling mechanism structured to couple a first anchor to the first metallic pillar, and a second coupling mechanism structured to couple a second anchor to the second metallic pillar. The overmolded non-metallic coating extends peripherally around each of the first metallic pillar and the second metallic pillar to position vibration-attenuating non-metallic material of the coating between the metallic base and each of the first metallic pillar and the second metallic pillar.

In still another aspect, a method of fastening a track rail to a substrate includes positioning a fastening mechanism upon a substrate such that a plurality of anchors within the substrate are received within a plurality of vertically extending bores extending through a plurality of metallic pillars of the fastening mechanism. The method further includes positioning a track rail in contact with a rail support surface of the fastening mechanism that is located laterally between the plurality of metallic pillars. The method further includes clamping the track rail to the fastening mechanism, and coupling the plurality of anchors to the plurality of metallic pillars, such that an overmolded non-metallic coating of the fastening mechanism is positioned in a vibration transmission path between the plurality of metallic pillars and the metallic base to attenuate vibrations transmitted between the track rail and the substrate.

DETAILED DESCRIPTION

Figure 1:
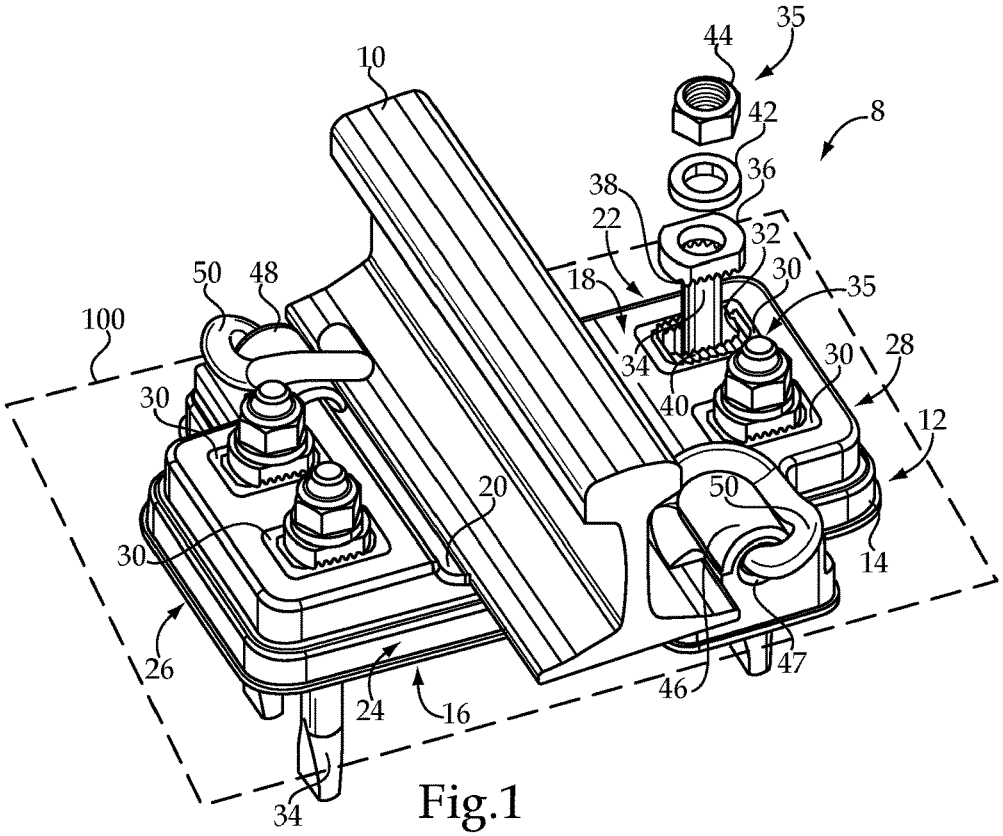
FIG. 1 is a diagrammatic view of a system for coupling track rail to a substrate, according to one embodiment.

Referring to FIG. 1, there is shown a system 8 for fastening a track rail 10 to a substrate 100. Substrate 100 may include a poured concrete slab or the like, however, the present disclosure is not thereby limited. System 8 includes a fastening mechanism 12 that includes a fastener body 14 with a horizontally extending lower side 16, and a horizontally extending upper side 18. Upper side 18 has a rail support surface 20 thereon that extends fore and aft between a front edge 22 and a back edge 24 of fastener body 14, and laterally between a left outboard edge 26 and a right outboard edge 28 of fastener body 14. It can be seen from FIG. 1 that a profile of fastener body 14, and in particular upper side 18, is non-uniform, and rail support surface 20 may be positioned vertically lower than adjacent portions of fastener body 14. Track rail 10 can therefore be seen and understood to be somewhat nested with fastener body 14. Fastening mechanism 12 may include a first clip receiver 46 and a second clip receiver 48, each defining a horizontally extending bore, one of which is shown and identified by way of reference numeral 47. Bore 47 and the counterpart bore of clip receiver 48 are structured to receive a first retention clip and a second retention clip, respectively, each identified via reference numeral 50, for clamping track rail 10 against rail support surface 20. Fastener body 14 may be formed by a metallic base and an overmolded non-metallic coating encasing the metallic base, features of each of which are further discussed herein. Clip receiver 46 and clip receiver 48 may each be attached to or formed integrally with the subject metallic base, providing support for clips 50 to clamp track rail 10 against fastener body 14 as shown. As will be further apparent from the following description, the design and construction of fastening mechanism 12, including material selection and placement of non-metallic material versus metallic material can be expected to provide various advantages over existing track rail fixation strategies, and notably with respect to vibration attenuation and lateral adjustability.

Figure 2:
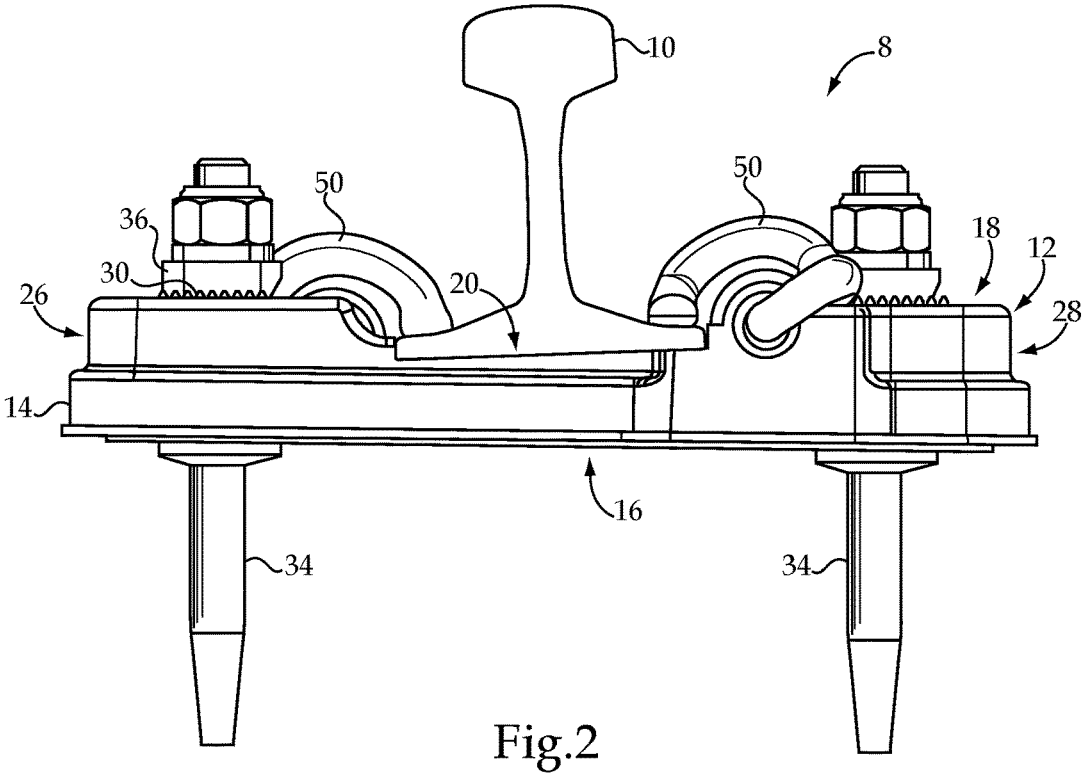
FIG. 2 is an end view of the system of FIG. 1.

Referring now also to FIG. 2, fastening mechanism 12 may further include a first metallic pillar 30 positioned at a first location laterally between rail support surface 20 and left outboard edge 26, and a second metallic pillar 30 positioned at a second location laterally between rail support surface 20 and right outboard edge 28. In a practical implementation strategy, a plurality of identical pillars 30 may be positioned on a first lateral side of rail support surface 20, and another plurality of pillars 30 positioned upon the opposite lateral side of rail support surface 20, with first and third, and second and fourth pillars 30 being arranged in pairs on the opposite sides of rail support surface 20 in a generally rectangular pattern to correspond with a conventional rectangular pattern of anchors 34 within a substrate, the significance of which, especially for retrofitting purposes, will be apparent from the following description. No particular number of pillars or anchor pattern is required within the context of the present disclosure, however.

Each of metallic pillars 30 may be substantially rectangular in horizontal cross-section, or horizontal end view as shown. Each of pillars 30 may further define a vertically extending bore, such that a first one of pillars 30 is understood to define a first vertically extending bore and a second one of pillars 30 is understood to define a second vertically extending bore. Each of the vertically extending bores 32 communicate between lower side 16 and upper side 18, such that they are structured to receive one of anchors 34. Anchors 34 may be coupled such as by clamping each to a corresponding one of pillars 30. As further discussed herein, coupling or clamping mechanisms 35 are provided for coupling anchors 34 to pillars 30. It can also be noted from the end view of FIG. 2 that rail support surface 20 forms a slope that dips toward left outboard edge 26, and may be understood to dip toward a first one of pillars 30 between rail support surface 20 and left outboard edge 21. In a practical implementation strategy, the terms "left" and "right," and "fore" and "aft," as used herein can refer to parts of fastening mechanism 12 in the embodiment depicted in FIGS. 1 and 2. In other instances, a fastening mechanism according to the present disclosure might be designed symmetrically and/or without any handedness, so that it could be installed in more than one possible orientations, for example. Various shims could also be used with fastening mechanism 12 for leveling, tilting, or to various other ends.

Figure 3:
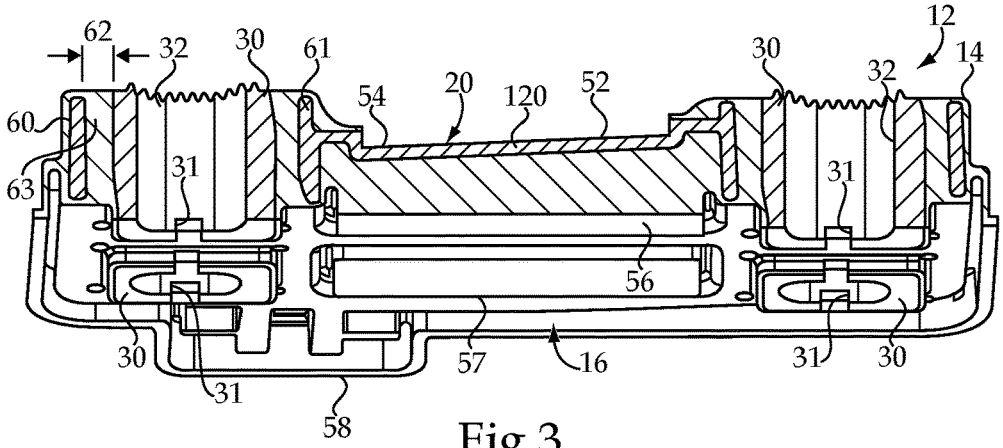
FIG. 3 is a sectioned view of a fastening mechanism for use in the system of FIGS. 1 and 2, according to one embodiment.

Referring also to FIG. 3, there is shown a sectioned view through fastening mechanism 12 and illustrating various additional features. It will be recalled that the selection and placement of metallic material versus non-metallic elastomeric or other material, for example synthetic rubber or natural rubber, is considered to provide various advantages. In a practical implementation strategy, pillars 30 may be isolated or substantially isolated from any contact with metallic base 52 by way of overmolded non-metallic coating 54 as shown in FIG. 3. Overmolded coating 54 may extend peripherally around each of the first, second, and optionally additional metallic pillars 30 to position vibration-attenuating non-metallic material of coating 54 between metallic base 52 and each of pillars 30. In FIG. 3, vibration-attenuating non-metallic material can be seen extending between pillars 30 and metallic base 52 in vertical, as well as horizontal fore and aft and lateral directions in the general manner described. Pillars 30 may be clamped directly into contact with the underlying substrate, however, the present disclosure is not limited as such. Drainage slots 31 may be formed in pillars 31 to enable draining of water out of bores 32. Various additional features (not numbered) could be provided in or on pillars 30 to enable the overmolded non-metallic material to lockingly engage with, capture, or otherwise retain pillars 30 in contact with other components, including coating 54 itself. In FIG. 3, a material thickness 62 of non-metallic material 63 is shown. Material thickness 62 can be substantially uniform peripherally around each of metallic pillars 30, and understood to provide a substantially uniform layer of vibration-attenuating non-metallic material extending between metallic base 52 and each of pillars 30. Non-metallic material 63 may be resiliently and elastically deformable relative to non-metallic material 61. During service shocks and vibrations can be attenuated by way of elastic deformation of non-metallic material 63, including principally shearing in certain embodiments. The present disclosure is not directed to any particular direction or orientation or pattern of deformation of non-metallic material 63, and deformation by way of shearing, compression, expansion can all be exploited to attenuate shocks and vibrations depending upon the geometry of the design and the service environment. The described selection and placement of materials can be understood to enable attenuating vibrations and shocks in fore and aft directions, lateral directions, vertical directions, etc. Additional non-metallic material can provide pads 56 and 57, described below. The various vibration and shock attenuation features described herein are believed to provide various advantages over known systems that tended to be very stiff laterally, as further discussed herein.

As noted above, a plurality of coupling mechanisms 35 may be provided for the purpose of coupling anchors 34 to pillars 30 such as by clamping. To this end, a disassembled clamping mechanism 35 is shown in FIG. 1, and includes a clamping plate in the form of a gauge adjustment plate 36, a lock washer 42, and a nut 44 structured to engage with threads on a corresponding one of anchors 34. Gauge adjustment plate 36 may be positioned about anchor 34, such that a set of teeth 38 on gauge adjustment plate 36 engage with a complementary set of teeth 40 on the corresponding pillar 30. Each of the sets of teeth 38 and 40 can generally be serrated in form, and project vertically downward and vertically upward, respectively, from their corresponding components. In a practical implementation strategy, each coupling mechanism 35 and the corresponding teeth 38 and 40 can be structured so as to define a lateral range of coupling or clamping locations. Each gauge adjustment plate 36 may be structured to position the corresponding anchor 34 at a selected clamping location within the lateral range. In reference to FIG. 2, it can be seen that gauge adjustment plate 36 could be positioned to the left or to the right of the position shown, and by positioning each coupling mechanism 35 appropriately, fastening mechanism 12 could be coupled to anchors 34 at a plurality of different lateral locations. The shape and size of pillars 30 and bores 32 may be such that anchors 34 can be positioned relatively more to the left, relatively more to the right, or somewhere in the middle. Rather than teeth or serrations as such, some different manner of mechanically fitting together and locking clamping mechanisms 35 relative to fastening mechanism 12 could be used to provide lateral adjustability.

As described herein, coating 54 encases metallic base 52. Coating 54 is understood therefore to coat metallic base 52, and may also have a variety of additional molded features that enable and/or enhance the functioning of fastening mechanism 12. To this end, coating 54 may include a plurality of pads 56 and 57 between horizontally extending lower side 16 and metallic base 52. In a practical implementation strategy, pads 56 and 57 may be structured to contact the substrate, to provide direct but resilient support for track rail 10 under loads. Pads could also be located at various places in fastener body 14, and in the illustrated embodiment at least one pad is positioned adjacent to and vertically below metallic base 52. Metallic base 52 may include a central rail-supporting core 120, and one or a plurality of pads may be positioned adjacent to and vertically below rail-supporting core 120. In a practical implementation strategy, coating 54 may further include a peripheral skirt 58 structured to seal against the underlying substrate. Skirt 58 may be downwardly projecting, and squeezed against the substrate by way of clamping forces coupling fastening mechanism 12 to the substrate.

Figure 4:
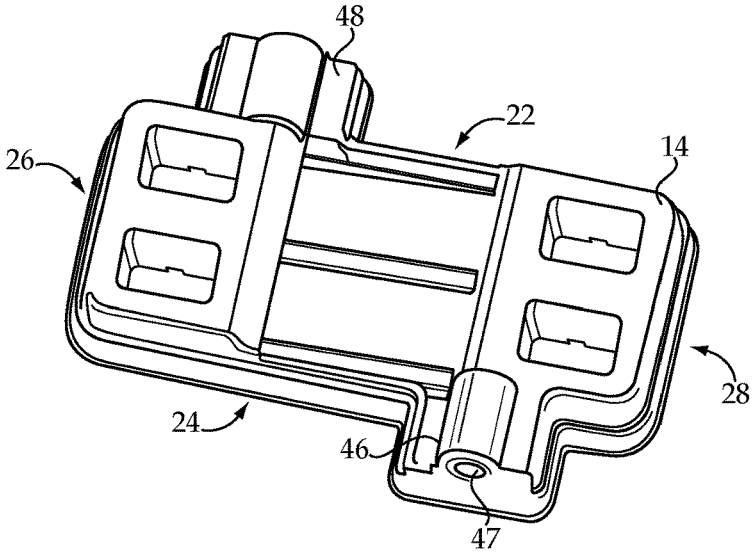
FIG. 4 is a diagrammatic view of a fastener body for a fastening mechanism, according to one embodiment.

Turning now to FIG. 4, there is shown fastener body 14 as it might appear having pillars 30 removed, and illustrating additional features of the molded contour provided by coating 54. It can also be seen from FIG. 4 that fastener body 14, and thus fastening mechanism 12, has a generally rectangular footprint that extends in fore and aft directions between front edge 22 and back edge 24, and in lateral directions between left outboard edge 26 and right outboard edge 28. It can also be seen from FIG. 4 that clip receiver 47 projects rearward of back edge 24, and clip receiver 48 projects forward of front edge 22.

Figure 5:
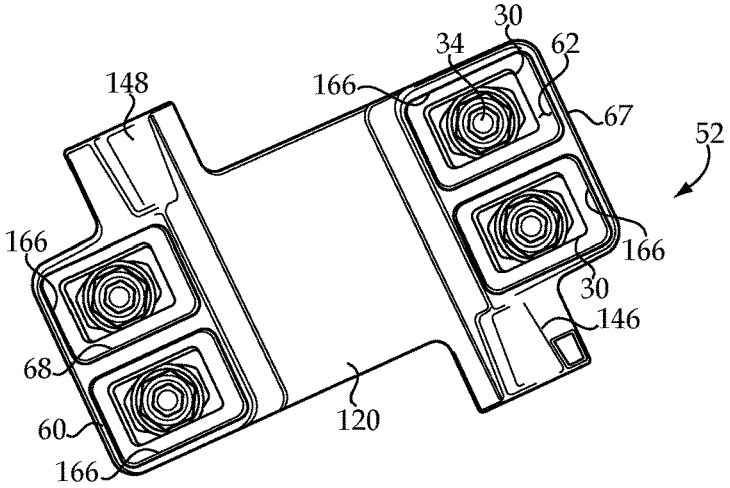
FIG. 5 is an elevational view of parts of a fastening mechanism, according to one embodiment.
Figure 6:
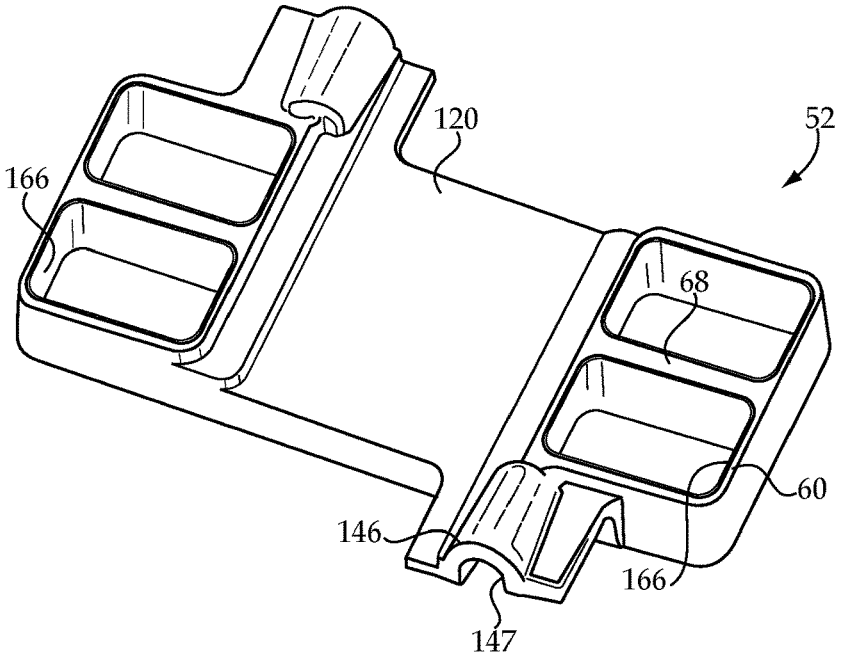
FIG. 6 is a perspective view of a metallic base for a fastening mechanism, according to one embodiment.
Figure 7:
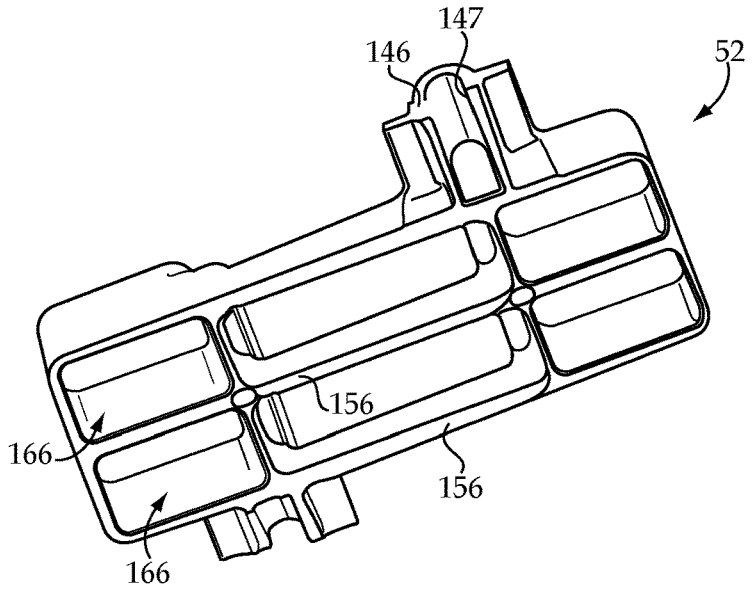
FIG. 7 is a different diagrammatic view of the metallic base of FIG. 6.

Referring now also to FIG. 5, there is shown an elevational view of metallic base 52, and pillars 30 and coupling mechanisms 35 as the various features might appear with coating 54 removed. As noted above, metallic base 52 may include a central rail-supporting core 120, that has a slope that dips toward a first metallic pillar 30, on the left of core 120. Metallic base 52 further includes a left outboard wall 60 extending from a left outboard side of rail-supporting core 120, and a right outboard wall 67 extending from a right outboard side of rail-supporting core 120. Each of outboard walls 60 and 67 defines a vertically extending opening 166 receiving a corresponding metallic pillar 30. In the illustrated embodiment, two openings receiving two pillars 30 are located on each of the left and right outboard sides of rail-supporting core 120. The multiple vertically extending openings formed on each of the outboard sides may be defined also in part by an internal wall 68, as shown on the left hand side of metallic base 52 in FIG. 5. Referring also to FIG. 6, there is shown a portion 146 of metallic base 52 that has a half-tube shape forming a part of clip receiver 46 when fastening mechanism 12 is assembled. A channel 147 is formed in portion 146 so as to a desired corresponding channel or bore shape in coating 54 and more particularly clip receiver 46. FIG. 7 illustrates still further features of metallic base 52, including a plurality of ribs 156 that extend laterally under rail-supporting core 120. Spaces between ribs 156 could be partially or wholly filled with overmolded, non-metallic material 63 when mechanism 12 is fully assembled.

INDUSTRIAL APPLICABILITY

Referring to the drawings generally, as alluded to above mechanism 12 is anticipated to be advantageous in a variety of applications, but in particular for retrofitting in place of existing fastening mechanisms that are of a similar type and worn, or of a different type altogether. During servicing a section of track, a track rail or section of a track rail may be decoupled from existing fastening mechanisms, such as by removing retention clips similar to clips 50 described herein. The track rail can then be lifted vertically above a plurality of fastening mechanisms, such that the fastening mechanisms can be decoupled from anchors and removed. The new fastening mechanisms, any of the fastening mechanism embodiments contemplated herein, may be positioned upon the underlying substrate such that the preexisting anchors held fast within the substrate are received within vertically extending bores through metallic pillars of the fastening mechanism. Once one or more replacement fastening mechanisms are positioned in place of the existing or old fastening mechanisms, the track rail may be lowered into contact with the rail support surfaces of the retrofitted fastening mechanisms, and the track otherwise prepared for service.

It will be recalled that the preexisting anchors can be coupled at a selected location anywhere within a range of available clamping locations. Accordingly, a technician may move the fastening mechanism to the left or to the right, potentially in conjunction with measuring a distance from a parallel rail, until a desired positioning is obtained. The track rail may be clamped to the fastening mechanism, such as by installing clips 50, and the plurality of anchors may be clamped to the metallic pillars as described herein. Clips such as clips 50 might be used to clamp the track rail to the fastening mechanism prior to completing clamping the plurality of anchors to the pillars, although the present disclosure is not limited to any particular sequence of events. In any event, clamping the preexisting anchors to pillars in the fastening mechanism will establish a vibration transmission path where non-metallic material in the coating of the fastening mechanism is positioned in the vibration transmission path between pillars such as pillars 30 and a metallic base such as base 52, so as to attenuate vibrations transmitted between the track rail and the substrate.

From the foregoing description it will appreciated that concepts according to the present disclosure can attenuate ground borne vibrations, reducing noise and potentially other undesired consequences of passing a train or the like over a particular section of track. In addition to vibration attenuation, the present disclosure provides for enhanced lateral adjustability enabling an optimum gauge of the track to be provided, either upon installation or during routine servicing. It has been observed that stiffness in earlier systems tended to be associated with excessive and progressive wear that increased rail gauge, and therefore improved ability to laterally adjust track rail location enables compensating for such wear. The present disclosure also offers reduced components in a fastening mechanism, and therefore in at least certain instances reduced cost and increased reliability.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A fastening mechanism for coupling track rail to a substrate comprising:

a one-piece fastener body formed by a metallic base having a central rail-supporting core and an overmolded non-metallic coating encasing the metallic base, the fastener body including a horizontally extending lower side, and a horizontally extending upper side having a rail support surface extending fore and aft between a front edge and a back edge of the fastener body, and laterally between a left outboard edge and a right outboard edge of the fastener body;

a first metallic pillar positioned at a first location laterally between the rail support surface and the left outboard edge, and a second metallic pillar positioned at a second location laterally between the rail support surface and the right outboard edge;

the first metallic pillar and the second metallic pillar defining a first vertically extending bore and a second vertically extending bore, respectively, and each of the first vertically extending bore and the second vertically extending bore communicating between the lower side and the upper side of the fastener body and being structured to receive an anchor held fast within the substrate and coupled to the corresponding first metallic pillar or second metallic pillar;

the overmolded non-metallic coating extending peripherally around each of the first metallic pillar and the second metallic pillar to position vibration-attenuating non-metallic material of the coating between the metallic base and each of the first metallic pillar and the second metallic pillar; and a pad positioned adjacent to and vertically below the rail-supporting core and formed by a continuous extent of the overmolded non-metallic coating that extends from the central rail-supporting core to the horizontally extending lower side.

2. The mechanism of claim 1 further comprising a first clip receiver and a second clip receiver attached to the metallic base and extending fore and aft, respectively, of the rail support surface, and each of the first clip receiver and the second clip receiver defining a horizontally extending bore structured to receive a first retention clip and a second retention clip, respectively, for clamping a track rail against the rail support surface.

3. The mechanism of claim 1 wherein the rail support surface forms a slope that dips toward the left outboard edge.

4. The mechanism of claim 1 wherein each of the first metallic pillar and the second metallic pillar includes a plurality of teeth structured to engage with complementary teeth of a first clamping plate and a second clamping plate, respectively, positioned about the corresponding anchor and structured to define a range of coupling locations.

5. The mechanism of claim 4 further comprising a third metallic pillar positioned between the rail support surface and the left outboard edge, and a fourth metallic pillar positioned between the rail support surface and the right outboard edge, and each of the third and the fourth metallic pillars having a configuration substantially identical to the first and the second metallic pillars.

6. The mechanism of claim 5 wherein the metallic base includes a first outboard wall defining a first and a second vertically extending opening structured to receive the first and the third metallic pillar, and a second outboard wall defining a third and a fourth vertically extending opening structured to receive the second and the fourth metallic pillar, and the central rail-supporting core is positioned between the first outboard wall and the second outboard wall.

7. The mechanism of claim 1 wherein the pad is one of a first pad and a second pad positioned between the horizontally extending lower side and the central rail-supporting core, and further comprising a second pad and a third pad positioned, respectively, between the horizontally extending lower side and the first clip receiver and the second clip receiver.

8. The mechanism of claim 7 wherein the overmolded non-metallic coating includes a skirt extending peripherally about the plurality of pads and structured to seal against the substrate.

9. A system for fastening track rail comprising:

a fastening mechanism including a one-piece fastener body formed by a metallic base having a central rail-supporting core and an overmolded non-metallic coating encasing the metallic base, and including an upper side, a horizontally extending lower side, and a rail support surface for supporting a track rail thereon at a location vertically above a substrate;

the fastening mechanism further including a first metallic pillar positioned at a first location on a first lateral side of the rail support surface, and a second metallic pillar positioned at a second location on a second lateral side of the rail support surface, and the first metallic pillar and the second metallic pillar defining a first vertically extending bore and a second vertically extending bore, respectively, each structured to receive an anchor held fast within the substrate;

a first coupling mechanism structured to couple a first anchor to the first metallic pillar, and a second coupling mechanism structured to couple a second anchor to the second metallic pillar;

the overmolded non-metallic coating extending peripherally around each of the first metallic pillar and the second metallic pillar to position vibration-attenuating non-metallic material of the coating horizontally between the metallic base and each of the first metallic pillar and the second metallic pillar; and the overmolded non-metallic coating further extending between the central rail-supporting core and the horizontally extending lower side to position vibration-attenuating material vertically between the metallic base and the substrate.

10. The system of claim 9 wherein each of the first metallic pillar and the second metallic pillar includes a set of teeth, and each of the first and the second coupling mechanisms includes complementary teeth.

11. The system of claim 10 wherein the sets of teeth of the first and the second metallic pillars and the sets of complementary teeth of the first and second coupling mechanisms are arranged so as to define a lateral range of coupling locations, and the first and the second coupling mechanisms include gauge adjustment plates structured to position the corresponding anchor at a selected coupling location within the lateral range.

12. The system of claim 9 wherein the overmolded non-metallic coating includes a plurality of pads positioned adjacent to and vertically below the rail-supporting core.

13. The system of claim 12 wherein the metallic base further includes a first outboard wall extending from a first outboard side of the rail-supporting core, and a second outboard wall extending from a second outboard side of the rail-supporting core, and each of the first and the second outboard wall defining a vertically extending opening receiving the corresponding first or second metallic pillar.

14. The system of claim 13 wherein each of the first outboard wall and the second outboard wall defines a plurality of vertically extending openings, and wherein the first metallic pillar includes one of a plurality of identical metallic pillars upon the first outboard side of the rail-supporting core and the second metallic pillar includes one of a plurality of identical metallic pillars upon the second outboard side of the rail-supporting core.

15. The system of claim 12 wherein the central rail-supporting core includes a slope that dips toward the first metallic pillar.

16. The system of claim 15 wherein:

the fastening mechanism includes a generally rectangular footprint extending in fore and aft directions between a front edge and a back edge, and in lateral directions between a left outboard edge and a right outboard edge, and the fastening mechanism further includes a first clip receiver projecting forward of the front edge and a second clip receiver projecting rearward of the back edge; and the plurality of pads includes a first pad positioned vertically beneath the first clip receiver and a second pad positioned vertically beneath the second clip receiver.

17. The system of claim 16 wherein the overmolded non-metallic coating includes a downwardly projecting peripheral skirt structured to seal against the substrate.

18. A method of fastening a track rail to a substrate comprising:

positioning a fastening mechanism upon a substrate such that a plurality of anchors within the substrate are received within a plurality of vertically extending bores extending through a plurality of metallic pillars positioned in a one-piece fastener body of the fastening mechanism;

positioning a track rail in contact with a rail support surface of the fastening mechanism that is located laterally between the plurality of metallic pillars;

clamping the track rail to the fastening mechanism; and coupling the plurality of anchors to the plurality of metallic pillars, such that an overmolded non-metallic coating of the one-piece fastener body is positioned in a vibration transmission path horizontally between the plurality of metallic pillars and the metallic base, and positioned vertically between and in contact with each of the substrate and the metallic base, to attenuate vibrations transmitted between the track rail and the substrate.

19. The method of claim 18 wherein the coupling of the plurality of anchors further includes clamping the anchors at one of a plurality of available clamping locations in a lateral range of clamping locations.

20. The method of claim 18 wherein the positioning of the fastening mechanism includes retrofitting the fastening mechanism in place of an existing fastening mechanism.

* * * * *